US007415926B2

(12) United States Patent
Nakamura et al.

(10) Patent No.: US 7,415,926 B2
(45) Date of Patent: Aug. 26, 2008

(54) STENCIL PRINTING MACHINE WITH STENCIL CLAMPING PORTION

(75) Inventors: Akira Nakamura, Ibaraki-ken (JP); Taku Naitou, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 34 days.

(21) Appl. No.: 11/032,011

(22) Filed: Jan. 11, 2005

(65) Prior Publication Data

US 2005/0150401 A1 Jul. 14, 2005

(30) Foreign Application Priority Data

Jan. 13, 2004 (JP) ..... P2004-005871

(51) Int. Cl.
*B41L 13/06* (2006.01)
*B41F 27/12* (2006.01)

(52) U.S. Cl. ..... 101/116; 101/415.1

(58) Field of Classification Search ..... 101/116, 101/415.1, 477, 216, 217, 117, 118, 378, 101/382.1, 383, 386
See application file for complete search history.

(56) References Cited

U.S. PATENT DOCUMENTS 2,209,127 A * 7/1940 Lowe ..... 101/415.1
4,304,182 A * 12/1981 Etchell et al. ..... 101/415.1
5,419,243 A * 5/1995 Hanzawa et al. ..... 101/116
5,461,976 A * 10/1995 Forehand ..... 101/31.1
5,560,298 A * 10/1996 Krokolinski et al. ..... 101/486
6,240,845 B1 * 6/2001 Koppelkamm ..... 101/415.1
6,460,457 B1 * 10/2002 Ramsay ..... 101/477
6,561,094 B1 * 5/2003 Schneider et al. ..... 101/415.1
6,604,460 B2 * 8/2003 Watanabe ..... 101/119
6,655,283 B2 * 12/2003 Deslangle et al. ..... 101/477
6,672,209 B1 * 1/2004 Charette et al. ..... 101/415.1
2001/0015147 A1 * 8/2001 Koppelkamm ..... 101/415.1
2001/0042475 A1 * 11/2001 Kimura ..... 101/477
2002/0011158 A1 * 1/2002 Maeda et al. ..... 101/118
2002/0040655 A1 * 4/2002 Mizutani et al. ..... 101/477
2002/0174788 A1 * 11/2002 Deslangle et al. ..... 101/415.1

FOREIGN PATENT DOCUMENTS

JP 08-048069 2/1996

* cited by examiner

*Primary Examiner*—Leslie J Evanisko
(74) *Attorney, Agent, or Firm*—The Nath Law Group; Jerald L. Meyer; Derek Richmond

(57) ABSTRACT

A stencil clamping portion which clamps a tip end of a stencil sheet on an outer peripheral wall of a drum is provided, and the stencil sheet clamped by the stencil clamping portion is wound and attached around the outer peripheral wall. The stencil clamping portion includes an insertion slit which is provided along an axial direction of the drum and open to a surface of the outer peripheral wall, and an elastic sheet which pinches the stencil sheet inserted into the insertion slit. The tip end of the stencil sheet is inserted into the insertion slit by an insertion blade, and pinched by the elastic sheet.

11 Claims, 11 Drawing Sheets

STENCIL PRINTING MACHINE WITH STENCIL CLAMPING PORTION

BACKGROUND OF THE INVENTION

1. Field of the Invention

The present invention relates to a stencil printing machine which conveys a print medium while pressing the print medium to a drum on which a stencil sheet is mounted, and transfers ink oozing from perforations of the stencil sheet onto the print medium, and more particularly, to a technology for clamping a tip end of the stencil sheet by the drum.

2. Description of the Related Art

Such a type of stencil printing machine includes a stencil making unit which forms a perforated image on a stencil sheet, a printing unit which rotates a drum on which the stencil sheet having the perforated image formed thereon is mounted, conveys a print sheet while pressing the print sheet to the rotating drum, and transfers an ink image onto the print sheet, a paper feed unit which feeds the print sheet to the printing unit at predetermined timing, a paper discharge unit which discharges the print sheet printed by the printing unit to a predetermined position, and a stencil disposal unit which peels off the stencil sheet from an outer peripheral wall of the drum, and conveys the peeled-off stencil sheet into a stencil disposal box. Moreover, in order to neatly attach the stencil sheet having the perforated image formed thereon onto the drum without any slack or wrinkle, a stencil clamping portion is provided on the outer peripheral wall of the drum.

As a conventional example of the stencil clamping portion, there is one shown in FIG. 1 (in Japanese Patent Laid-Open Publication No. Hei 8-48069 (published in 1996). As shown in FIG. 1, such a stencil clamping portion 100 includes a stencil base 102 provided on an outer peripheral wall 101 of a drum, a magnet portion 103 provided on an inner surface side of the stencil base 102, and a clamping plate 104 which is supported so as to be freely rotatable with respect to the stencil base 102, and is shifted between a clamping position where the clamping plate 104 is absorbed to the stencil base 102 and a clamping release position where the clamping plate 104 is apart from the stencil base 102. The clamping plate 104 is moved by clamp moving means (not shown) on a machine body side.

In the configuration described above, when a tip end of a made stencil sheet 110 is conveyed to an upper surface of the stencil base 102, the clamping plate 104 is shifted from the clamping release position to the clamping position. Then, the clamping plate 104 is absorbed to the stencil base 102 by magnetic force of the magnet portion 103, and the tip end of the stencil sheet 110 is pinched between the clamping plate 104 and the stencil base 102. Specifically, the tip end of the stencil sheet 110 is clamped on the drum by the magnetic force of the magnet portion 103. Then, the outer peripheral wall 101 of the drum is rotated in a state where the drum clamps the tip end of the stencil sheet 110 thereon, and by this rotation of the outer peripheral wall 101, the stencil sheet 110 is wound around the outer peripheral wall 101, thus being loaded thereon.

However, in the conventional stencil clamping portion 100, the tip end of the stencil sheet 110 is sent out from a stencil making unit (not shown) to a position above the stencil base 102, and the stencil sheet 110 is mounted on the stencil base 102 in a state where no tension is applied thereto. Then, the clamping plate 104 moves by the rotation to the upper surface of the stencil sheet 110 to which no tension is applied, and clamps the stencil sheet 110. Accordingly, there is a possibility that the slack or the wrinkle occurs on the clamped stencil sheet 110. If the slack or the wrinkle occurs on the clamped stencil sheet 110, the stencil sheet 110 cannot be neatly attached onto the outer peripheral wall 101 of the drum without any slack or wrinkle.

SUMMARY OF THE INVENTION

It is an object of the present invention to provide a stencil printing machine capable of clamping the tip end of the stencil sheet without causing any slack or wrinkle.

In order to achieve the foregoing object, a first aspect of the present invention provides a stencil printing machine, which includes a drum having an outer peripheral wall around which a stencil sheet is to be wound, and a stencil clamping portion which clamps a tip end of the stencil sheet on the outer peripheral wall, wherein the stencil clamping portion includes an insertion slit open to a surface of the outer peripheral wall, an insertion blade which inserts the tip end of the stencil sheet into the insertion slit, and a pinch device which pinches the stencil sheet inserted into the insertion slit by the insertion blade.

According to the present invention, when the tip end of the stencil sheet placed at a position above the stencil clamping portion is pressed by the insertion blade, the tip end of the stencil sheet is inserted into the insertion slit while being pressed by the insertion blade, and when the tip end is inserted into the insertion slit, pinching force of the pinch device functions on the inserted tip end of the stencil sheet, and the tip end is clamped on the stencil clamping portion. The tip end of the stencil sheet is inserted into the insertion slit in a state where tension is applied thereto, and accordingly, no slack or wrinkle occurs on the stencil sheet.

In a preferred embodiment of the present invention, the outer peripheral wall is freely rotatable and formed of an ink impermeable member, and the stencil printing machine further includes an ink supply portion which is provided in a printing area and supplies ink to the surface of the outer peripheral wall, and a pressure roller which transfers the supplied ink from perforations of the stencil sheet to a printing medium by pressing force.

With the above-described configuration, it is satisfactory if the outer peripheral wall of the drum is formed of the ink impermeable member, and accordingly, options for selecting the material are expanded. Moreover, simple structure is sufficient for the outer peripheral wall. Accordingly, the outer peripheral wall can be manufactured at low cost, and the stencil clamping portion can be easily placed thereon. Furthermore, strength of the drum can be easily increased, and accordingly, unevenness of an image owing to variations of printing pressure and the like can be prevented.

In the above-described stencil printing machine, the stencil clamping portion is provided not to protrude from the surface of the outer peripheral wall.

With the above-described configuration, even if the pressure roller is located at a press position, the pressure roller does not collide against the stencil clamping portion. Accordingly, it is not necessary to shift the pressure roller between the press position and a standby position for each rotation of the drum, and it is easy to drive the pressure roller. Moreover, it is not necessary to shift the pressure roller during printing, and accordingly, drawbacks such as noise caused by the pressure roller and a deterioration of image quality owing to a rebound of the pressure roller can be solved. Furthermore, in the case where the outer peripheral wall is formed of the ink impermeable member, the outer peripheral wall can be formed of a cylindrical member having rigidity and thickness. Accordingly, a concave portion is formed on the outer peripheral wall, thus making it possible to fabricate the stencil clamping portion which does not protrude to the outer peripheral wall.

In the above-described stencil printing machine, the pinch device may be placed on at least one of side faces of the insertion slit, and may include an elastic member which is flexibly deformed in a direction of widening the insertion slit when the stencil sheet is inserted into the insertion slit.

With the above-described configuration, the pinching force to pinch the tip end of the stencil sheet concentrates on a tip edge of the elastic member. Accordingly, large clamping force can be obtained owing to a wedge effect of the elastic member.

Moreover, in the above-described stencil printing machine, the pinch device may be placed on at least one of side faces of the insertion slit, and may include an elastic block which is compressively deformed in a direction of widening the insertion slit when the stencil sheet is inserted into the insertion slit.

With the above-described configuration, it is satisfactory if the elastic block is placed in a concave portion, and accordingly, the stencil clamping portion is simple and easy to fabricate.

In the above-described stencil printing machine, an angle between the insertion slit and a surface of the outer peripheral wall around which the stencil sheet is wound is set at an angle which does not exceed 90 degrees.

With the above-described configuration, at an exit of the insertion slit to the outer peripheral wall, the stencil sheet is bent acutely. Accordingly, when force to pull backward the stencil sheet wound around the outer peripheral wall functions thereon, the pulling force can be accepted by such an acutely bent spot of the stencil sheet. Therefore, the stencil sheet can be surely prevented from falling off from the insertion slit.

DETAILED DESCRIPTION OF THE PREFERRED EMBODIMENTS

An embodiment of the present invention is described below based on the drawings.

Figure 1:
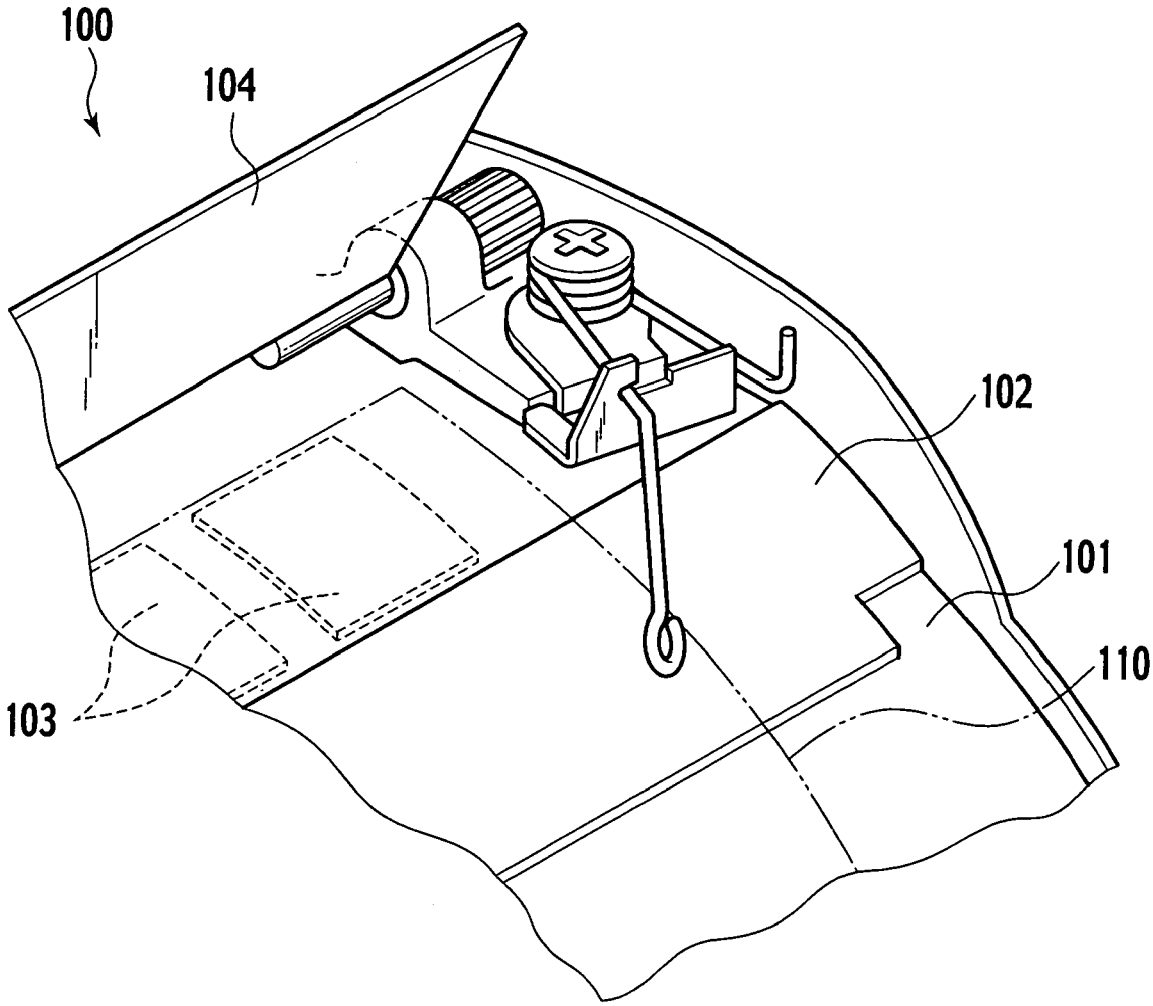
FIG.1 PRIOR ART
FIG. 1 is a perspective view showing a stencil clamping portion of a conventional example.
Figure 2:
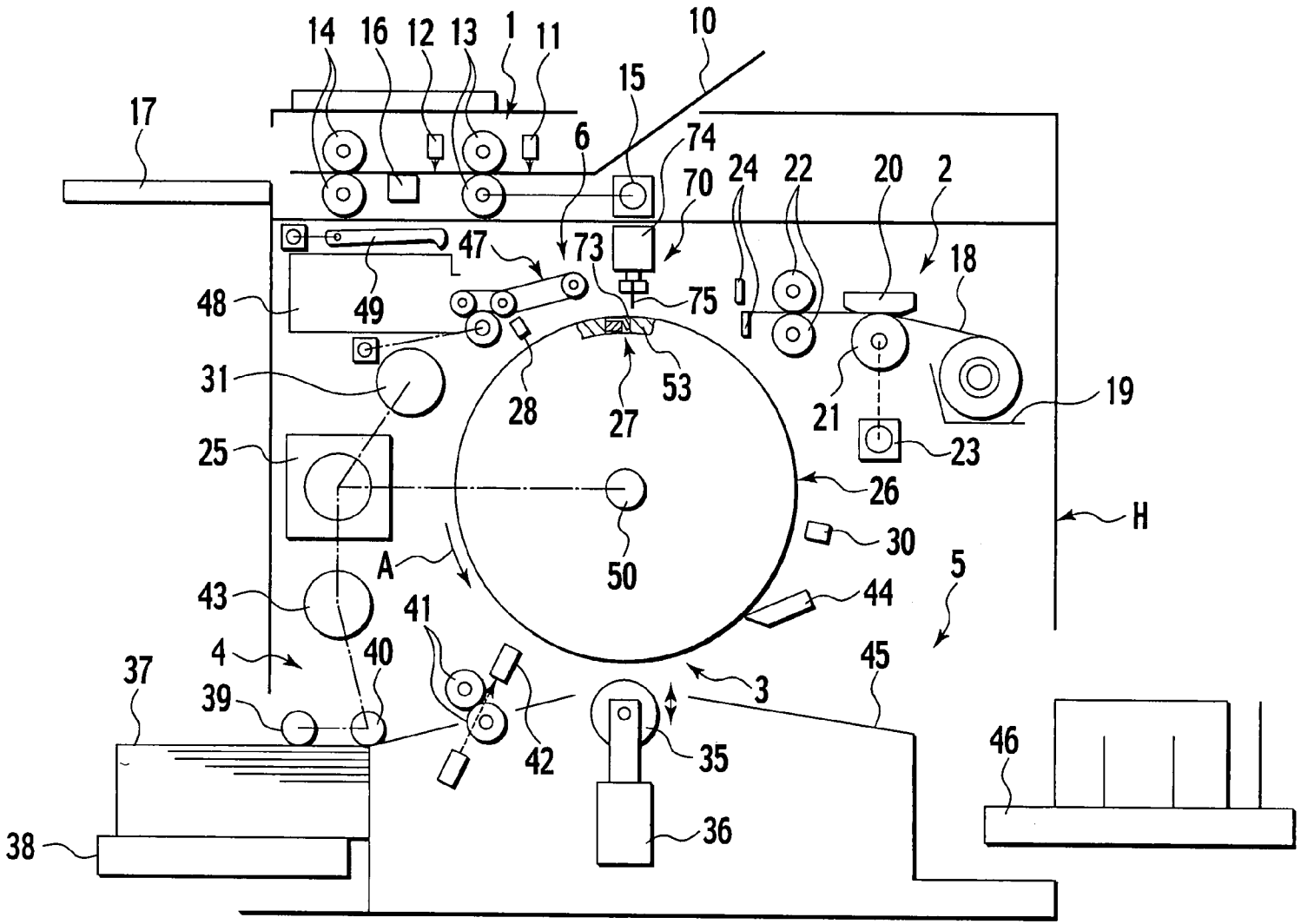
FIG. 2 shows an embodiment of the present invention and is a schematic configuration view of a stencil printing machine.

As shown in FIG. 2, a stencil printing machine includes an original reading unit 1, a stencil making unit 2, a printing unit 3, a paper feed unit 4, a paper discharge unit 5, and a stencil disposal unit 6.

The original reading unit 1 includes an original setting tray 10 on which an original to be printed is mounted, reflective-type original sensors 11 and 12 which detect the presence of the original on the original setting tray 10, original conveyer rollers 13 and 14 which convey the original on the original setting tray 10, a stepping motor 15 which rotationally drives the original conveyer rollers 13 and 14, a contact image sensor 16 which optically reads image data of the original conveyed by the original conveyer rollers 13 and 14 and converts the read data into electrical signals, and an original discharge tray 17 on which the original discharged from the original setting tray 10 is mounted. The original mounted on the original setting tray 10 is conveyed by the original conveyer rollers 13 and 14, and the image sensor 16 reads the image data of the conveyed original.

The stencil making unit 2 includes a stencil housing 19 which houses a long and rolled stencil sheet 18, a thermal print head 20 placed downstream of the stencil housing 19 in a conveying direction, a platen roller 21 placed at a position opposite to the thermal print head 20, a pair of stencil transfer rollers 22 and 22 placed downstream of the platen roller 21 and the thermal print head 20 in the conveying direction, a write pulse motor 23 which rotationally drives the platen roller 21 and the stencil transfer rollers 22 and 22, and a stencil cutter 24 placed downstream of the pair of stencil transfer rollers 22 and 22 in the conveying direction.

The long stencil sheet 18 is conveyed by the rotation of the platen roller 21 and the stencil transfer rollers 22 and 22. Based on the image data read by the image sensor 16, each of dot-shaped heating elements of the thermal print head 20 selectively performs a heating operation, and thus the stencil sheet 18 is perforated due to thermal sensitivity thereof to make a stencil. Then, the stencil sheet 18 thus made is cut by the stencil cutter 24 to make the stencil sheet 18 with a predetermined length.

The printing unit 3 includes a drum 26 which rotates in a direction of an arrow A of FIG. 2 by driving force of a main motor 25, a stencil clamping portion 27 which is provided on the drum 26 and clamps a tip end of the stencil sheet 18, a stencil insertion device 70 which inserts the tip end of the stencil sheet 18 into the stencil clamping portion 27, and an ink supply device 54 which supplies ink to a surface of the drum 26.

Moreover, the printing unit 3 includes a stencil confirming sensor 28 which detects whether or not the stencil sheet 18 is wound and attached around an outer peripheral surface of the drum 26, a reference position detecting sensor 30 which detects a reference position of the drum 26, and a rotary encoder 31 which detects rotation of the main motor 25. Based on a detection output of the reference position detecting sensor 30, a pulse outputted from the rotary encoder 31 is detected, thus enabling a rotation position of the drum 26 to be detected.

Furthermore, the printing unit 3 includes a pressure roller 35 placed below the drum 26. The pressure roller 35 is constructed to be shiftable between a press position where the pressure roller 35 presses the outer peripheral surface of the drum 26 by driving force of a solenoid device 36 and a standby position where the pressure roller 35 is apart from the outer peripheral surface of the drum 26. The pressure roller 35 is always located at the press position during a printing mode period (including a trail print mode) and located at the standby position during a period other than the printing mode period.

Then, the tip end of the stencil sheet 18 conveyed from the stencil making unit 2 is clamped by the stencil clamping portion 27, and the drum 26 is rotated in such a clamping state, so that the stencil sheet 18 is wound and attached around the outer peripheral surface of the drum 26. Then, print sheets (printing media) 37, which are fed by the paper feed unit 4 in synchronization with the rotation of the drum 26, are pressed onto the stencil sheet 18 wound around the drum 26 by the pressure roller 35. Thus, the ink is transferred from perforations of the stencil sheet 18 onto the print sheets 37, and an image is printed thereon.

The paper feed unit 4 includes a paper feed tray 38 on which the print sheets 37 are stacked, first paper feed rollers 39 and 40 which convey only the uppermost print sheet 37, a pair of second paper feed rollers 41 and 41 which convey the print sheet 37, which has been conveyed by the first paper feed rollers 39 and 40, between the drum 26 and the pressure roller 35 in synchronization with the rotation of the drum 26, and a paper feed sensor 42 which detects whether or not the print sheet 37 is conveyed between the pair of second paper feed rollers 41 and 41. The first paper feed rollers 39 and 40 are constructed such that the rotation of the main motor 25 is selectively transmitted thereto through a paper feed clutch 43.

The paper discharge unit 5 includes a sheet separator claw 44 which separates the printed print sheets 37 from the drum 26, a conveying passage 45 through which the print sheets 37 separated from the drum 26 by the sheet separator claw 44 are conveyed, and a paper receiving tray 46 on which the print sheets 37 discharged from the conveying passage 45 are mounted.

The stencil disposal unit 6 includes disposed stencil conveying means 47, a stencil disposal box 48, and a disposed stencil compression member 49. The disposed stencil conveying means 47 is located at a peeling-off position of the stencil sheet 18, where the disposed stencil conveying means 47 is brought into substantially intimate contact with the stencil sheet 18, and conveys the stencil sheet 18 while peeling off a rear end thereof from the outer peripheral surface of the drum 26. The stencil disposal box 48 houses the stencil sheet 18 conveyed by the disposed stencil conveying means 47. The disposed stencil compression member 49 pushes the stencil sheet 18, which has been conveyed by the disposed stencil conveying means 47 into the stencil disposal box 48, into a bottom of the stencil disposal box 48.

Figure 3:
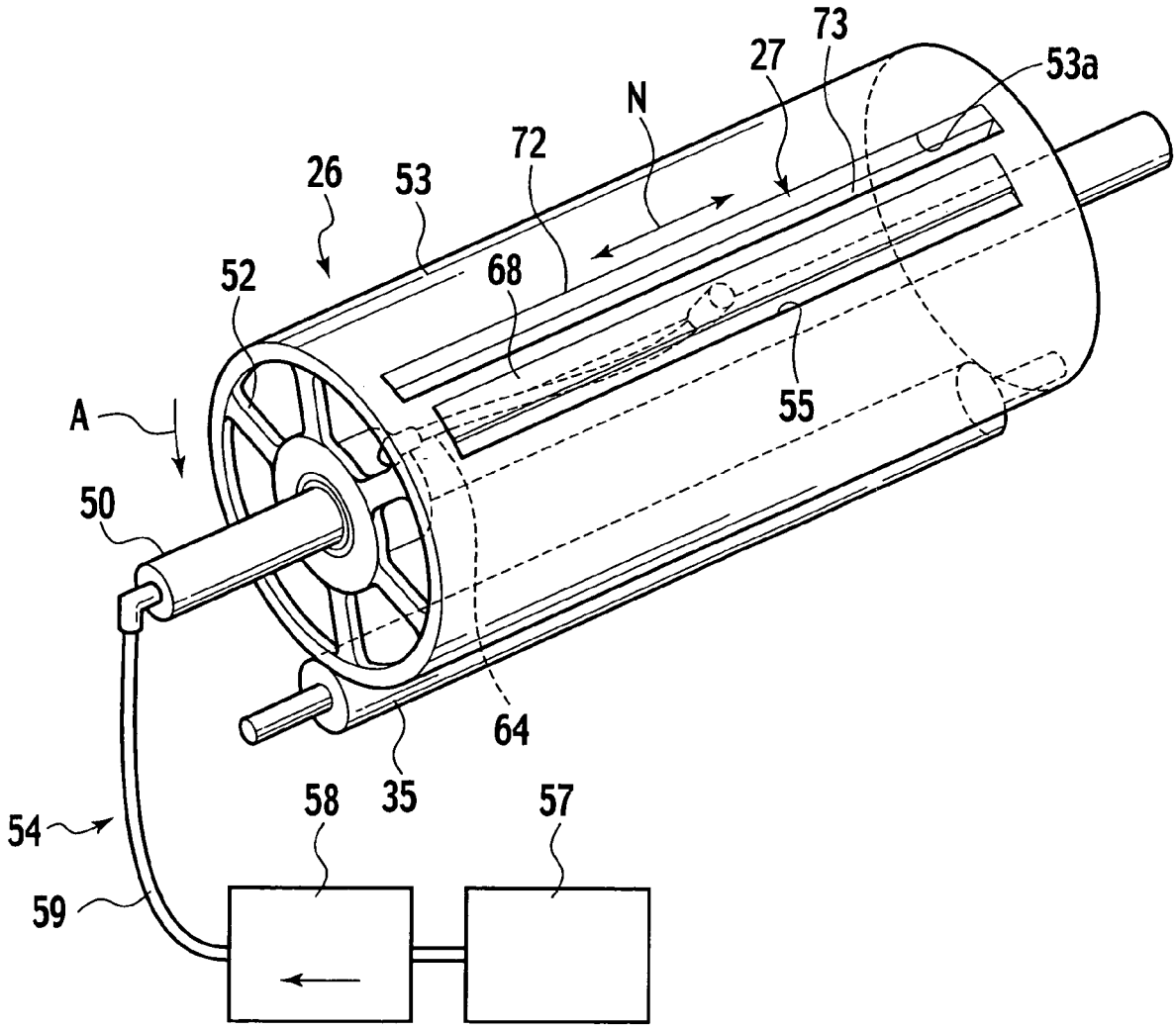
FIG. 3 shows the embodiment of the present invention and is a perspective view of a drum.
Figure 4:
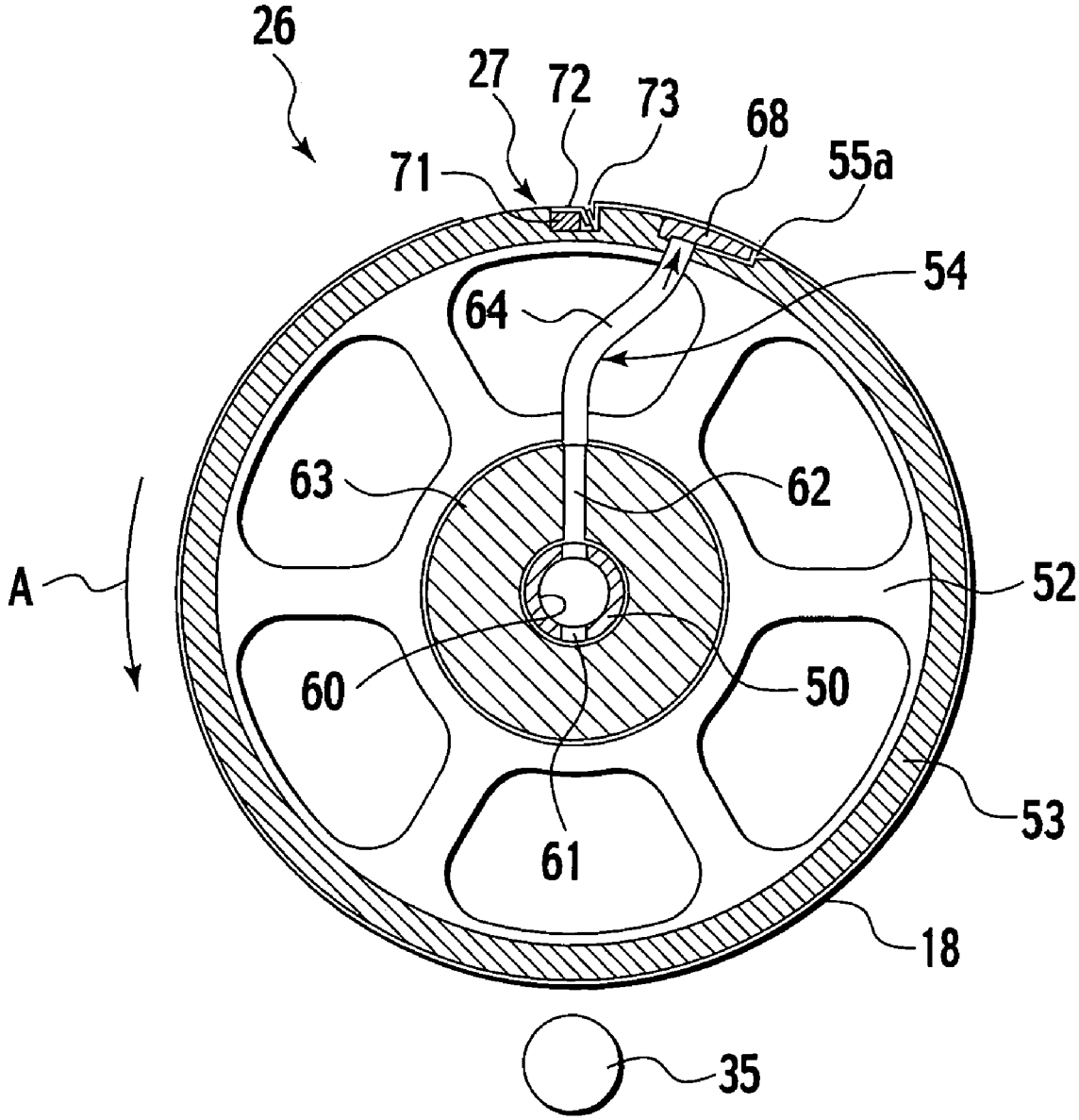
FIG. 4 shows the embodiment of the present invention and is a cross-sectional view of the drum.

Next, configurations of the drum 26, the stencil clamping portion 27, the stencil insertion device 70 and the ink supply device 54 are described. As shown in FIGS. 3 and 4, the drum 26 includes a support shaft 50 fixed to a machine body H (show in FIG. 2), a pair of side disks 52 and 52 supported on the support shaft 50 so as to be freely rotatable with bearings interposed therebetween, respectively, and a cylindrical outer peripheral wall 53 fixed between the pair of side disks 52 and 52. The outer peripheral wall 53 is rotationally driven by rotation force of the main motor 25 together with the pair of side disks 52 and 52. Moreover, the outer peripheral wall 53 has rigidity, and is formed of an ink impermeable member which does not allow the ink to permeate therethrough. Furthermore, the outer peripheral surface of the outer peripheral wall 53 is processed with a fluorine-contained resin coating process such as a Teflon (registered trademark) coating process, and is formed into an even cylindrical surface.

Figure 5:
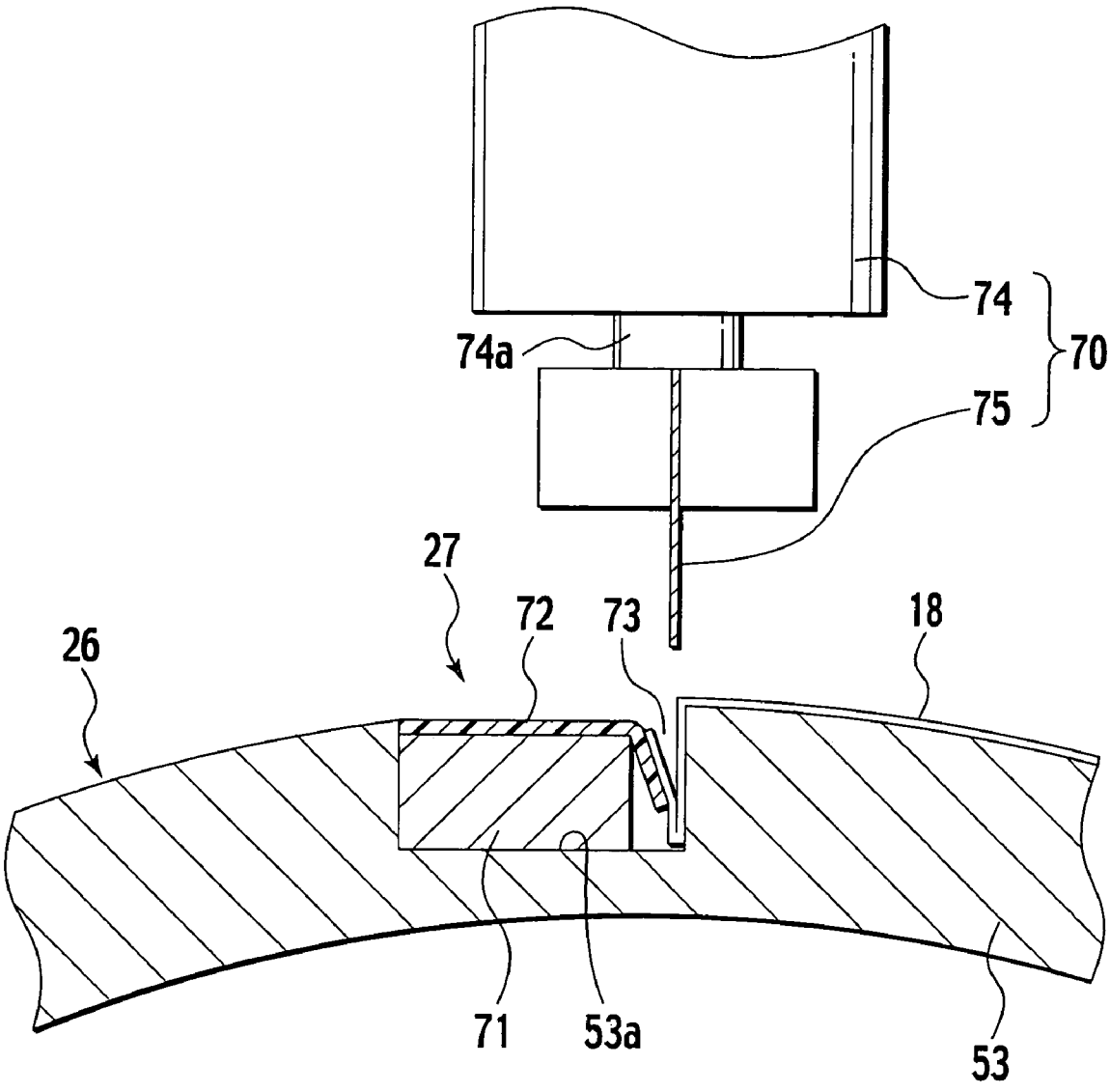
FIG. 5 shows the embodiment of the present invention and is a cross-sectional view of a stencil clamping portion.

As shown in FIG. 5, the stencil clamping portion 27 is composed of a concave portion 53*a* formed on the outer peripheral wall 53 along an axial direction of the support shaft 50, a sheet fixing member 71 placed in the concave portion 53*a*, an elastic sheet (elastic member) 72 that is a pinch device supported on the sheet fixing member 71, and an insertion slit 73 formed of the elastic sheet 72 and a side face of the concave portion 53*a*. The stencil clamping portion 27 is provided so as not to protrude from the outer peripheral wall 53.

The elastic sheet 72 is formed by bending a resin-made sheet member rich in elasticity, a tip end thereof is slanted in a direction where width thereof is gradually narrowed as going toward the bottom of the insertion slit 73, and a tip edge thereof is made to elastically abut on the side face of the concave portion 53*a*. Then, when the tip end of the stencil sheet 18 is inserted into the insertion slit 73, the tip end of the elastic sheet 72 is flexibly deformed in a direction of widening the insertion slit 73. Note that the elastic member is not limited to the elastic sheet 72, and a thin plate spring and the like may be used as the elastic member (pinch device).

The insertion slit 73 is provided along a direction (perpendicular-to-printing direction) perpendicular to a rotation direction A of the drum 26, that is, an axial direction of the drum 26, set to length more than width of the stencil sheet 18, and open to the surface of the outer peripheral wall 53.

The stencil insertion device 70 includes a solenoid device 74 fixed on the machine body H side, and an insertion blade 75 fixed to a drive rod 74*a* of the solenoid device 74 and placed immediately above the outer peripheral wall 53 of the drum 26. The insertion blade 75 is provided along the axial direction of the drum 26, and set to the length more than the width of the stencil sheet 18. By drive of the solenoid device 74, a tip end position of the insertion blade 75 is shifted between an insertion position (position shown in FIG. 8) where the tip end of the insertion blade 75 is inserted into the insertion slit 73 and a standby position where the tip end thereof is located above the outer peripheral wall 53.

Moreover, the outer peripheral wall 53 is rotated in the direction of the arrow A, and a position thereof rotated a little from the stencil clamping portion 27 is set at a printing start point. Hence, the rotation direction A becomes a printing direction, and an area that follows the printing start point is set as a printing area. In this first embodiment, the maximum printing area is set at a region sufficient for printing an A3-size sheet. Moreover, an ink supply portion 55 of the ink supply device 54 is provided on a place which is in the maximum printing area, and which is on the most upstream of the maximum printing area of the outer peripheral wall 53 in the printing direction.

In this embodiment, the most upstream position of the printing in the maximum printing area in which the ink supply portion 55 is arranged means a concept, literally including the most upstream position of the printing in the maximum printing area, and also including a position on the border line which sections the maximum printing area off the further upstream area onto which a printing is not made. In addition, the most upstream position of the printing in the maximum printing area in which the ink supply portions 55 are provided is defined, specifically, as a range in which ink that is supplied to the surface of the outer peripheral wall 53 can be dispersed at least towards the border line that sections the maximum printing area off the further upstream area onto which a printing is not made. The ink supply portion 55 may be arranged on the upstream position in each of a plurality of blocks on the outer peripheral wall 53 of the printing drum 26. The blocks are obtained by dividing the maximum printing area in the printing direction.

As shown in FIGS. 2 to 4, the ink supply device 54 includes an ink container 57 in which the ink is stored, an inking pump 58 which suctions the ink in the ink container 57, a first pipe 59 which supplies the ink suctioned by the inking pump 58, the support shaft 50 to which the other end of the first pipe 59 is connected and in which an ink passage 60 is formed and a hole 61 is formed at a position 180 degrees opposite thereto, a rotary joint 63 which is supported on an outer periphery of the support shaft 50 so as to be freely rotatable and in which a through hole 62 that communicates with the hole 61 is formed, a second pipe 64 in which one end thereof is connected to the rotary joint 63 and the other end thereof is connected to the outer peripheral wall 53, and the ink supply portion 55 to which the other end of the second pipe 64 is opened.

The ink supply portion 55 is open to the surface of the outer peripheral wall 53, and formed of an ink supplying concave portion (not denoted by reference numeral in particular) formed along the direction perpendicular to the rotation direction A of the outer peripheral wall 53 (that is, the perpendicular-to-printing direction N), and of an ink distribution member 68 formed inside the ink supplying concave portion.

Next, an operation of the stencil making machine constructed in the above-described manner is briefly described.

First, when a stencil making mode is selected, in the stencil making unit 2, the stencil sheet 18 is conveyed by the rotation of the platen roller 21 and the stencil transfer rollers 22 and 22. Based on the image data read by the original reading unit 1, a large number of heating elements of the thermal head 20 selectively perform the heating operation, and thus the stencil sheet 18 is perforated due to the thermal sensitivity thereof to make the stencil. Then, the stencil sheet 18 thus made is cut at a predetermined spot by the stencil cutter 24. Thus, the stencil sheet 18 with a desired dimension is made.

In the printing unit 3, the tip end of the stencil sheet 18 made in the stencil making unit 2 is clamped by the stencil clamping portion 27, and the drum 26 is rotated in such a clamping state, so that the stencil sheet 18 is wound, attached and loaded around the outer peripheral surface of the drum 26.

Next, when the printing mode is selected, in the printing unit 3, the drum 26 is rotationally driven, and the ink supply device 54 starts driving. Then, the ink is supplied from the ink supply portion 55 to the outer peripheral wall 53, and the ink thus supplied is held between the outer peripheral wall 53 and the stencil sheet 18, and the pressure roller 35 is shifted from the standby position to the press position.

The paper feed unit 4 feeds the print sheets 37 between the drum 26 and the pressure roller 35 in synchronization with the rotation of the drum 26. The print sheets 37 thus fed are pressed against the outer peripheral wall 53 of the drum 26 by the pressure roller 35, and conveyed by the rotation of the outer peripheral wall 53 of the drum 26. Specifically, the print sheets 37 are conveyed while being brought into intimate contact with the stencil sheet 18.

Moreover, at the same time when the printed sheets 37 are conveyed, the ink held between the outer peripheral wall 53 of the drum 26 and the stencil sheet 18 is diffused downstream in the rotation direction A while being squeezed by pressing force of the pressure roller 35. The ink thus diffused oozes out of the perforations of the stencil sheet 18, and the image is transferred on the printed sheets 37. In the manner described above, an ink image is printed on the print sheets 37 in a process where the print sheets 37 pass between the outer peripheral wall 53 of the drum 26 and the pressure roller 35. With regard to the print sheets 37 which have come out from between the outer peripheral wall 53 of the drum 26 and the pressure roller 35, the tip ends thereof are peeled off from the drum 26 by the sheet separator claw 44. The print sheets 37 separated from the drum 26 are discharged through the conveying passage 45 to the paper receiving tray 46, and are stacked here.

When printing of the set number of print sheets is completed, the rotation of the outer peripheral wall 53 of the drum 26 is stopped, and the drive of the ink supply device 54 is stopped. Thus, the supply of ink to the outer peripheral wall 53 is stopped. Moreover, the pressure roller 35 is returned back to the standby position from the press position, and goes into a standby mode.

When making of a new stencil is started and so on and a stencil disposal mode is thus selected, the disposed stencil conveying means 47 is shifted to the peeling-off position of the stencil sheet 18. When the drum 26 is rotated backward and the disposed stencil conveying means 47 is driven, the rear end of the stencil sheet is gradually peeled off from the drum 26 while being conveyed by the disposed stencil conveying means 47. The peeled-off stencil sheet 18 is conveyed into the stencil disposal box 48 by conveying force of the disposed stencil conveying means 47. When the stencil sheet 18 becomes hardly wound and attached around the outer peripheral wall 53, the stencil sheet 18 is drawn out of the insertion slit 73 by the conveying force of the disposed stencil conveying means 47, and the clamping thereof is released. Here, the stencil sheet 18 is drawn out from substantially an insertion direction of the insertion slit 73, and accordingly, is drawn out easily. When the stencil sheet 18 of which clamping has been released is entirely conveyed into the stencil disposal box 48, the stencil disposal operation is completed.

Figure 6:
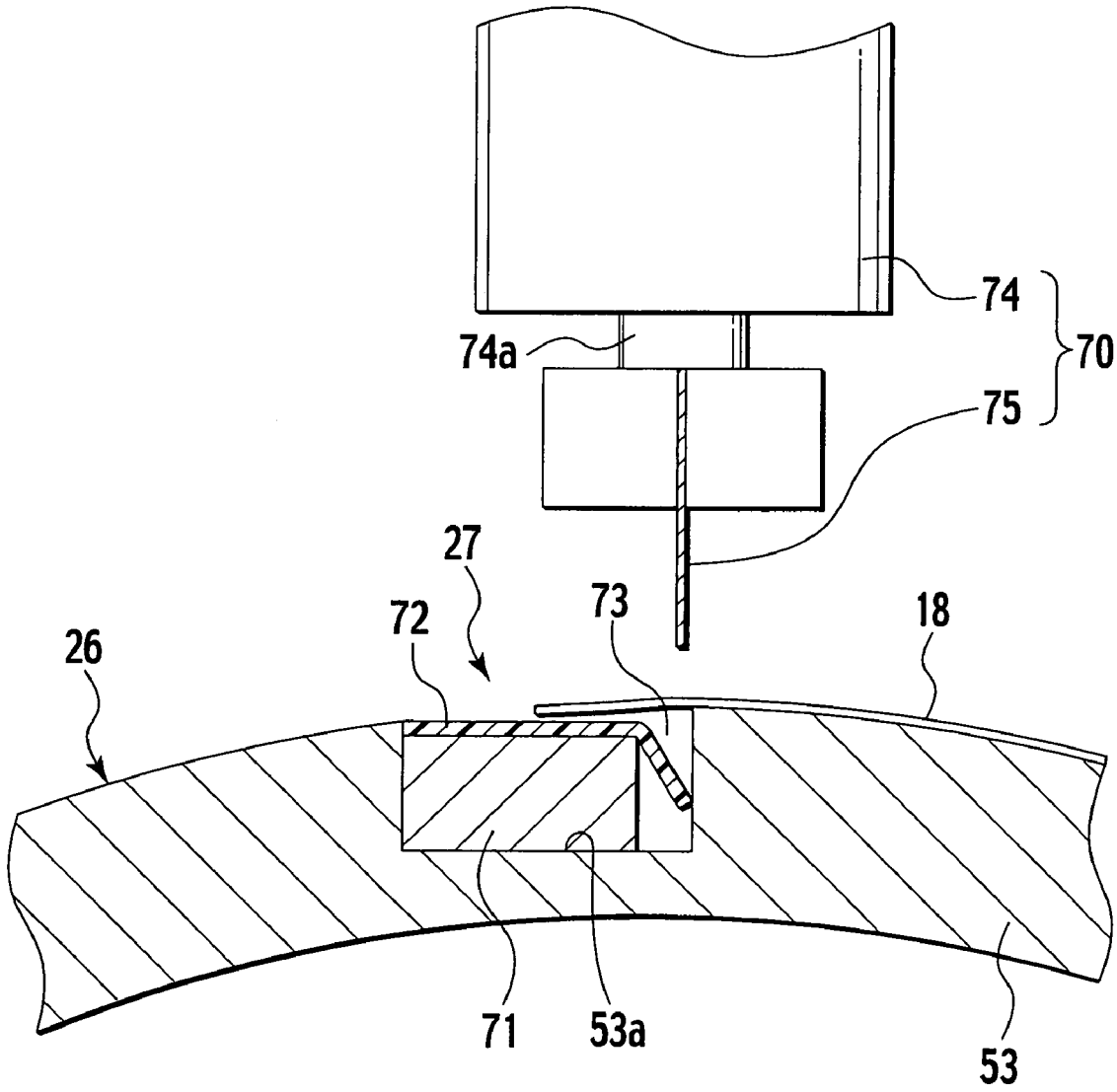
FIG. 6 shows the embodiment of the present invention and is a cross-sectional view showing a state of conveying a tip end of a stencil sheet to a position above the stencil clamping portion.

Next, the clamping operation of the stencil sheet 18 in the above-described operation process is described in detail. When the stencil-making operation in the stencil making unit 2 is completed, as shown in FIG. 6, the tip end of the made stencil sheet 18 is conveyed to a position above the stencil clamping portion 27, and more accurately, the tip end of the stencil sheet 18 is conveyed to a position beyond the insertion slit 73.

Figure 7:
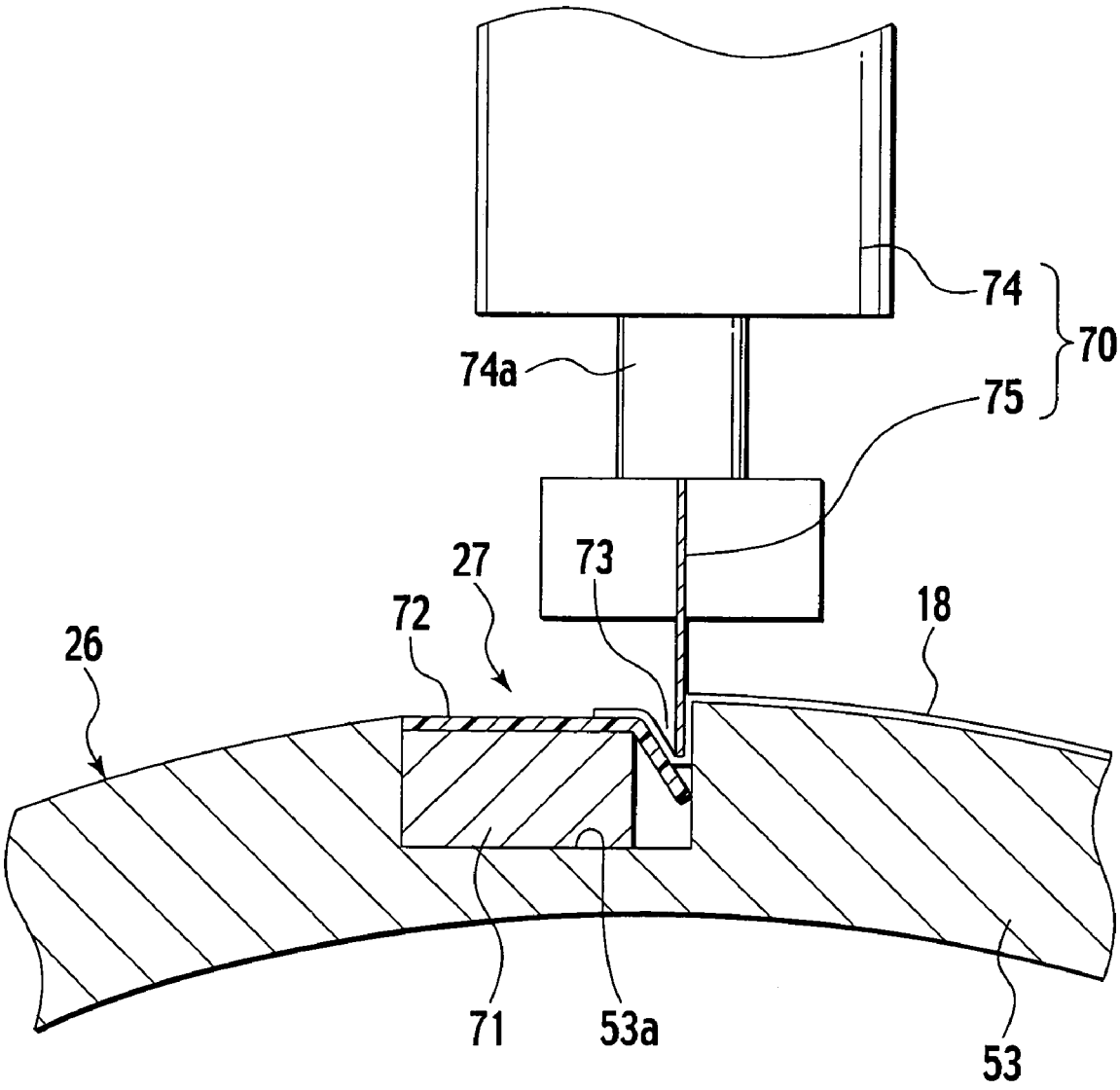
FIG. 7 shows the embodiment of the present invention and is a cross-sectional view showing a process where an insertion blade is being inserted into an insertion slit.
Figure 8:
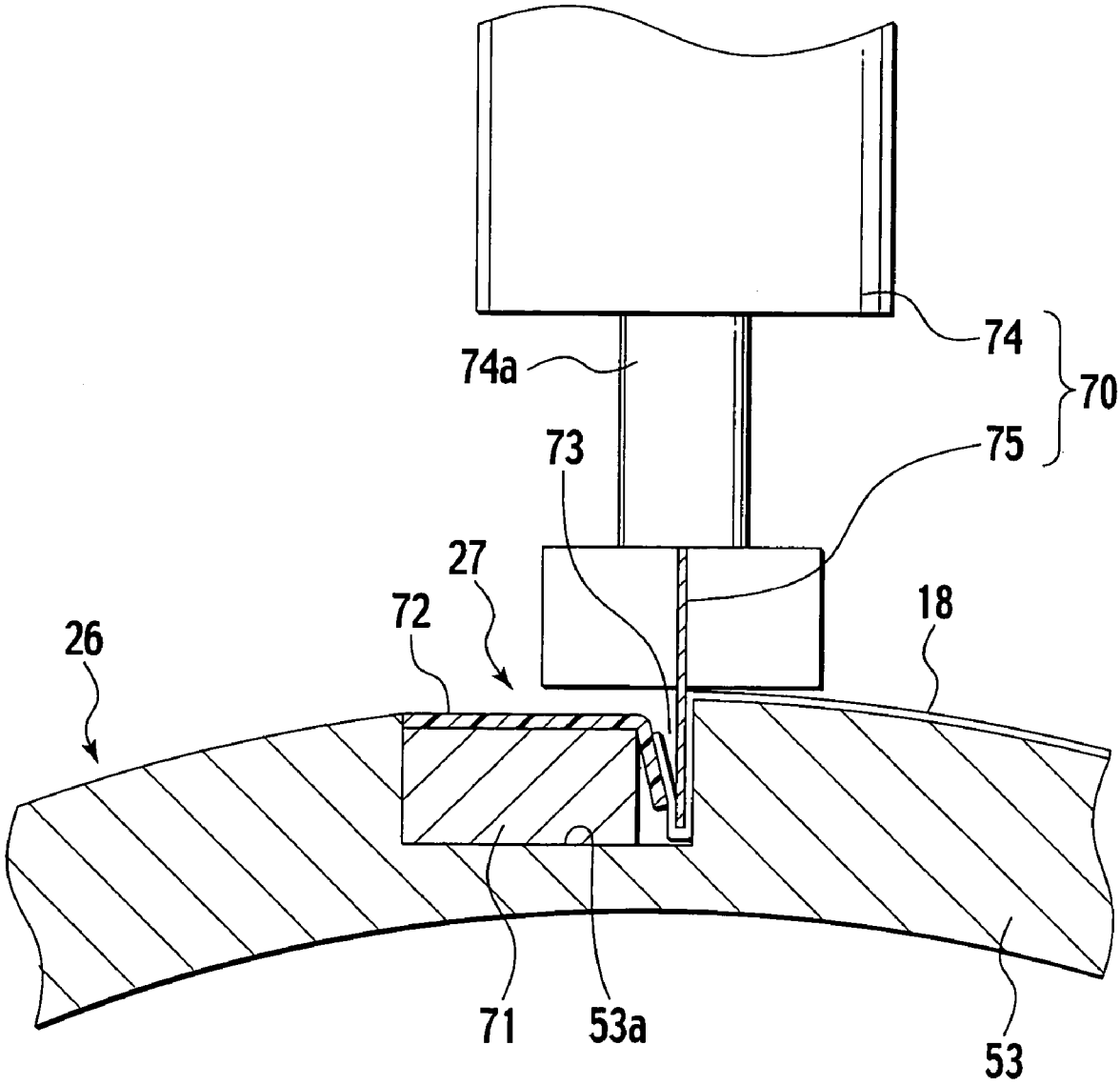
FIG. 8 shows the embodiment of the present invention and is a cross-sectional view showing a state where the insertion blade is inserted to an insertion position of the insertion slit.

Next, as shown in FIG. 7, the solenoid device 74 is driven, and the insertion blade 75 descends from the standby position to the insertion position. Then, the tip end of the stencil sheet 18 abuts on the tip end of the insertion blade 75 in this descending process, and the insertion blade 75 further descends from this abutting position to press the tip end of the stencil sheet 18 downward. By this pressing force, the tip end of the stencil sheet 18 is gradually inserted into the insertion slit 73 while being pressed by the insertion blade 75. Then, as shown in FIG. 8, when the insertion blade 75 is inserted to the insertion position, the tip end of the stencil sheet 18 is inserted more deeply than the tip edge of the elastic sheet 72.

When the insertion blade 75 is inserted to the insertion position, as shown in FIG. 5, the insertion blade 75 is returned back to the standby position. Pinching force of the elastic sheet 72 functions on the tip end of the stencil sheet 18 inserted into the insertion slit 73. Accordingly, the tip end of the stencil sheet 18 does not fall off from the insertion slit 73, but only the insertion blade 75 returns back to the standby position. Thereafter, the tip end of the stencil sheet 18 is clamped by the pinching force of the elastic sheet 73.

In the above-described process of the clamping operation, the tip end of the stencil sheet 18 is pressed by the insertion blade 75, and in a state where tension is applied to the stencil sheet 18 by this pressing force, the stencil sheet 18 is inserted into the insertion slit 73. Accordingly, no slack or wrinkle occurs on the stencil sheet 18.

This embodiment is constructed such that the outer peripheral wall 53 is freely rotatable and formed of the ink impermeable member, that the ink supply portion 55 is provided at a printing position of the outer peripheral wall 53, which is upstream of the printing area, that the ink is supplied from the ink supply portion 55 to the surface of the outer peripheral wall 53, and that the ink thus supplied is transferred from the perforations of the stencil sheet 18 to the printing sheets 37 by the pressing force of the pressure roller 35. Hence, it is satisfactory if the outer peripheral wall 53 of the drum 26 is formed of the ink impermeable member, and accordingly, options for selecting the material are expanded. Moreover, simple structure is sufficient for the outer peripheral wall 53. Accordingly, the outer peripheral wall 53 can be manufactured at low cost, and the stencil clamping portion 27 can be easily placed thereon. Furthermore, strength of the drum can be easily increased, and accordingly, unevenness of the image owing to variations of printing pressure and the like can be prevented.

In this embodiment, the stencil clamping portion 27 is provided so as not to protrude from the surface of the outer peripheral wall 53. Accordingly, even if the pressure roller 35 is located at the press position, the pressure roller 35 does not collide against the stencil clamping portion 27. Therefore, it is not necessary to shift the pressure roller 35 between the press position and the standby position for each rotation of the drum 26, and it is easy to drive the pressure roller 35. Moreover, it is not necessary to shift the pressure roller 35 during the printing, and accordingly, drawbacks such as noise and a deterioration of image quality owing to a rebound of the pressure roller 35 can be solved. Furthermore, in the case where the outer peripheral wall 53 is formed of the ink impermeable member as in this embodiment, the outer peripheral wall 53 can be formed of a cylindrical member having rigidity and thickness. Accordingly, the concave portion 53*a* is formed on the outer peripheral wall 53, thus making it possible to fabricate the stencil clamping portion 27 which does not protrude to the outer peripheral wall 53.

In this embodiment, the pinch device is the elastic sheet 72 which is placed on one side face of the insertion slit 73 and flexibly deformed in the direction of widening the insertion slit 73. Accordingly, the pinching force to pinch the tip end of the stencil sheet 18 concentrates on the tip edge of the elastic sheet 72. Therefore, large clamping force can be obtained owing to a wedge effect of the elastic sheet 72. Note that the elastic sheet 72 may be placed on each of both side faces of the insertion slit 73.

Figure 9:
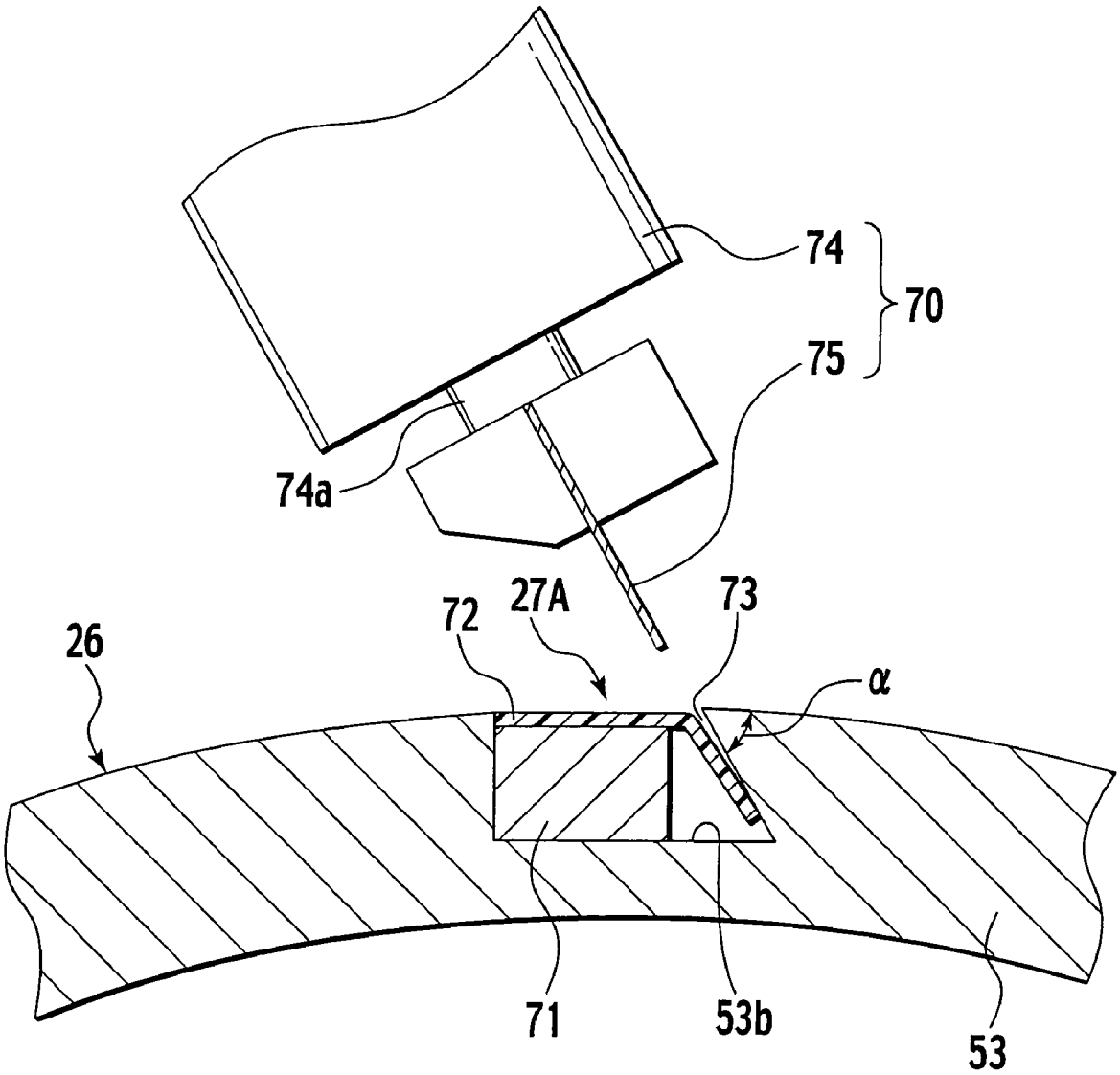
FIG. 9 is a cross-sectional view of a stencil clamping portion of a first modification.

FIG. 9 is a cross-sectional view showing a first modification of the stencil clamping portion.

In FIG. 9, a stencil clamping portion 27A of the first modification includes a concave portion 53*b* on the outer peripheral wall 53 as in the above-described embodiment. An angle made by one side face of the concave portion 53*b* and the outer surface of the outer peripheral wall 53 is set at an angle $\alpha$ which does not exceed 90 degrees. Thus, an insertion slit 73 formed of the side faces of the concave portion 53*b* and the elastic sheet 72 is placed so as to be slanted. Moreover, the stencil insertion device 70 is also placed slantingly after the fashion of the slant of the insertion slit 73. Note that other configurations are the same as those of the above-described embodiment, and accordingly, the same reference numerals are added to the same constituent portions, and description thereof is omitted.

In this first modification, the angle between the insertion slit 73 and the surface of the outer peripheral wall 53 around which the stencil sheet 18 is wound is set at the angle (acute angle) which does not exceed 90 degrees. Accordingly, at an exit of the insertion slit 73 to the outer peripheral wall 53, the stencil sheet 18 is bent acutely. Hence, when force to pull backward the stencil sheet 18 wound around the outer peripheral wall 53 functions thereon, the pulling force can be accepted by such an acutely bent spot of the stencil sheet 18. Accordingly, the stencil sheet 18 can be surely prevented from falling off from the insertion slit 73. Note that, when the stencil sheet 18 is drawn out from the same direction as the slanting direction of the insertion slit 73, it is possible to draw out the stencil sheet 18 with drawing force similar to that in the above-described embodiment, and accordingly, the clamping thereof can be released without any trouble.

Figure 10:
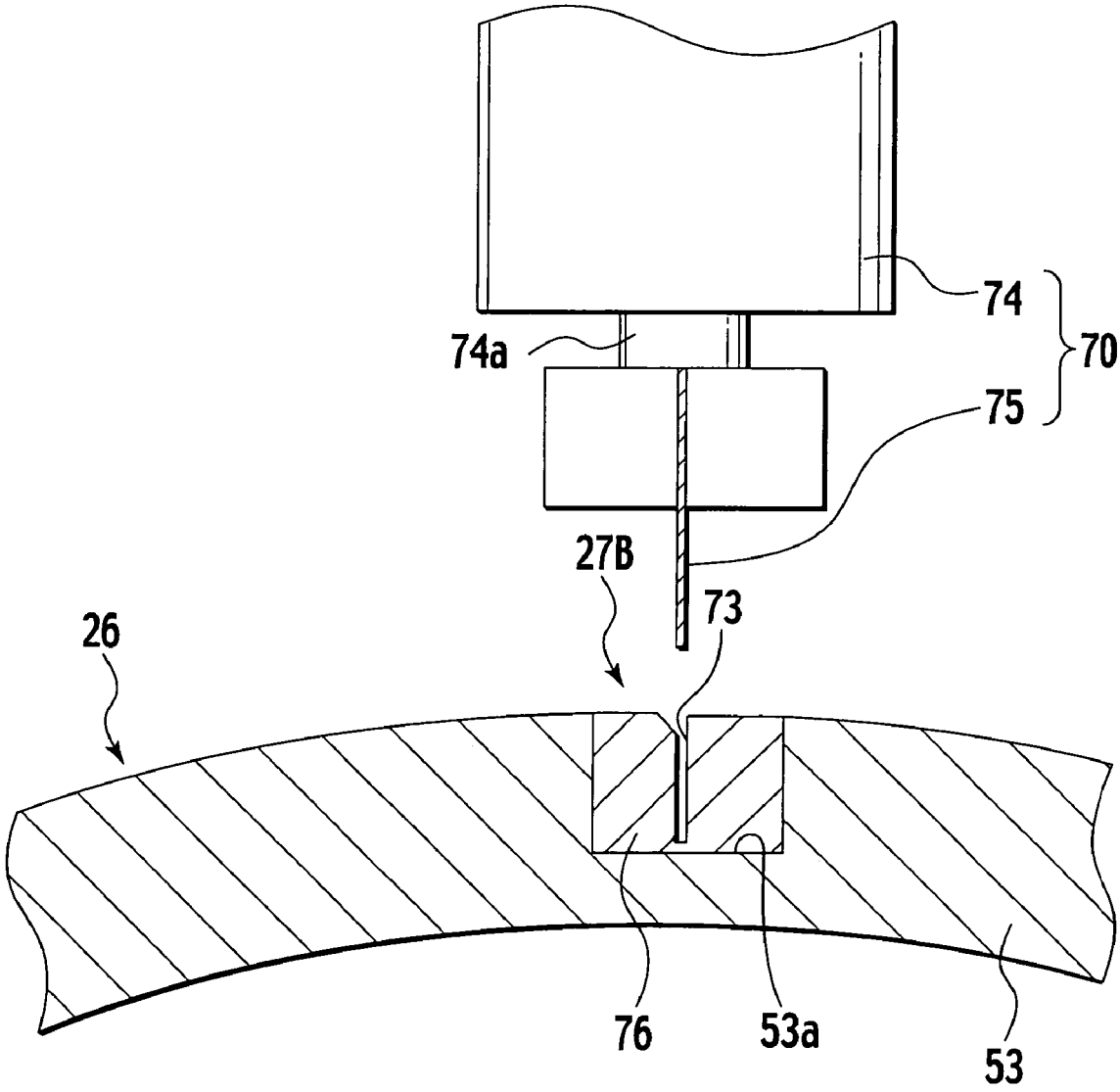
FIG. 10 is a cross-sectional view of a stencil clamping portion of a second modification.

FIG. 10 is a cross-sectional view showing a second modification of the stencil clamping portion.

A stencil clamping portion 27B of the second modification includes the concave portion 53*a* formed on the outer peripheral wall 53, an elastic block 76 that is a pinch device formed of an elastic material, and the insertion slit 73 formed in the elastic block 76. Both side faces of the insertion slit 73 are formed of the elastic block 76.

In this second modification, the pinch device is the elastic block 76 which is placed on both side faces of the insertion slit 73 and compressively deformed in the direction of widening the insertion slit 73 when the tip end of the stencil sheet 18 is inserted thereinto. Accordingly, it is satisfactory if the elastic block 76 is placed in the concave portion 53*a*. Therefore, the stencil clamping portion 27B is simple and easy to fabricate.

Note that, in this second modification also, as in the first modification, the angle between the insertion slit 73 and the surface of the outer peripheral wall 53 around which the stencil sheet 18 is wound may be set at the angle which does not exceed 90 degrees.

Figure 11:
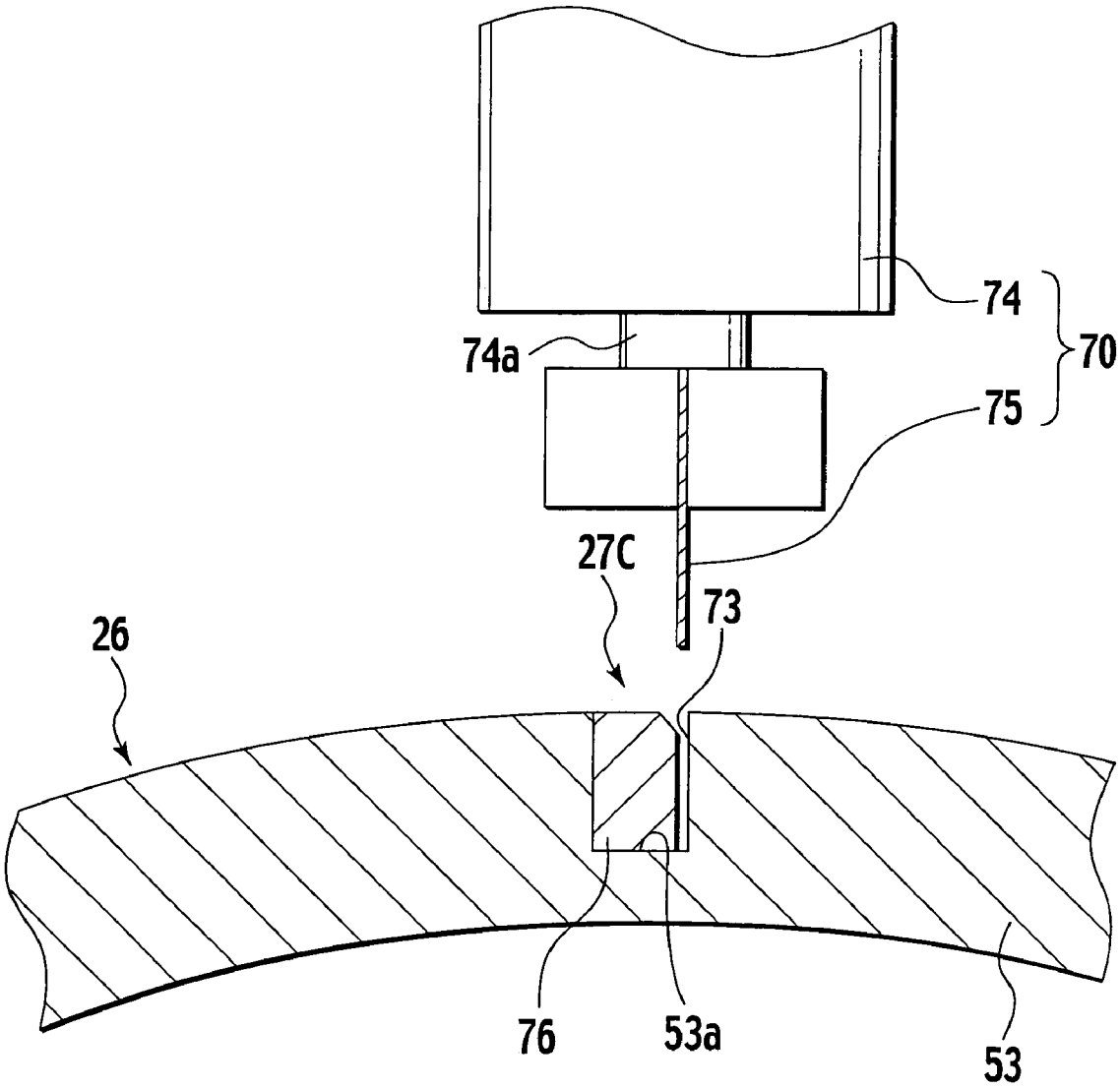
FIG. 11 is a cross-sectional view of a stencil clamping portion of a third modification.

FIG. 11 is a cross-sectional view showing a third modification of the stencil clamping portion.

A stencil clamping portion 27C of this third modification includes the concave portion 53*a* formed on the outer peripheral wall 53, the elastic block 76 that is the pinch device formed of an elastic material, and the insertion slit 73 formed of the elastic block 76 and a side face of the concave portion 53*a*. As compared with the insertion slit 73 of the second modification, in the insertion slit 73 of this third modification, one side face thereof is formed of the elastic block 76, and the other side face thereof is formed of the outer peripheral wall 53.

In this third modification also, as in the above-described second modification, the stencil clamping portion 27C can be made if the elastic block 76 with a predetermined dimension is simply placed in the insertion slit 73. Accordingly, the stencil clamping portion 27C is simple and easy to fabricate.

Note that, in this third modification also, as in the first modification, the angle between the insertion slit 73 and the surface of the outer peripheral wall 53 around which the stencil sheet 18 is wound may be set at the angle which does not exceed 90 degrees.

In the above-described embodiment, the case has been described, where the present invention is applied to the stencil printing machine in which the outer peripheral wall 53 of the drum 26 is formed of the ink impermeable member and the ink is supplied from the printing position of the outer peripheral wall 53, which is upstream of the printing area. However, the present invention is also applicable to a stencil printing machine in which the outer peripheral wall of the drum is formed of an ink permeable member and the ink is supplied from an inner periphery of the outer peripheral wall.

What is claimed is:

1. A stencil printing machine, comprising:

a drum having an outer peripheral wall around which a stencil sheet is to be wound; and a stencil clamping portion which clamps a tip end of the stencil sheet on the outer peripheral wall, wherein the stencil clamping portion comprises:

an insertion slit open to a surface of the outer peripheral wall;

a stencil insertion device fixed on the machine;

an insertion blade operatively connected to the stencil insertion device and having a tip end for insertion into the insertion slit and which inserts the tip end of the stencil sheet into the insertion slit such that the tip end of the stencil sheet abuts on the tip end of the insertion blade; and a pinch device which folds and pinches the stencil sheet inserted into the insertion slit by the insertion blade, wherein said insertion blade is slidable from a standby position, in which a distal end of said insertion blade is apart from said surface of said outer peripheral wall, to an inserted position, in which said distal end is within said insertion slit.

2. The stencil printing machine according to claim 1, wherein the outer peripheral wall is freely rotatable and formed of an ink impermeable member, and the stencil printing machine further comprises: p1 an ink supply portion which is provided in a printing area and supplies ink to the surface of the outer peripheral wall; and a pressure roller which transfers the supplied ink from perforations of the stencil sheet to a printing medium by pressing force.

3. The stencil printing machine according to claim 2, wherein the stencil clamping portion is provided not to protrude from the surface of the outer peripheral wall.

4. The stencil printing machine according to claim 1, wherein the pinch device comprises an elastic member which is flexibly deformed in a direction of widening the insertion slit when the stencil sheet is inserted into the insertion slit.

5. The stencil printing machine according to claim 1, wherein the pinch device is placed on at least one of side faces of the insertion slit, and comprises an elastic member which is compressively deformed in a direction of widening the insertion slit when the stencil sheet is inserted into the insertion slit.

6. The stencil printing machine according to claim 1, wherein an angle between the insertion slit and the surface of the outer peripheral wall around which the stencil sheet is wound is set at an angle which does not exceed 90 degrees.

7. The stencil printing machine according to claim 1, wherein the stencil insertion device includes a solenoid device, the operative connection of the insertion blade to the stencil insertion device achieved by an operable connection of the insertion blade to the solenoid device.

8. The stencil printing machine according to claim 1, further comprising:

a printing unit including the drum;

a stencil confirming sensor which detects a predefined condition of the stencil sheet with respect to the outer peripheral wall; and a reference position detecting sensor which detects a reference position of the drum, and a rotary encoder which detects rotation corresponding to drum position, thus enabling detection of a rotation position of the drum.

9. The stencil printing machine according to claim 1, further comprising:

a printing unit including the drum;

an ink supply device which supplies ink to a surface of the drum;

a stencil confirming sensor which detects a predefined condition of the stencil sheet with respect to the outer peripheral wall; and a pressure roller positioned below the drum and constructed to be shiftable between a press position where the pressure roller presses the outer peripheral wall by driving force of a solenoid device and a standby position of pressure roller apart from the outer peripheral wall, so as to position the pressure roller at the press position during a printing mode period and located at the standby position during a period other than the printing mode period.

10. The stencil printing machine according to claim 1, further comprising:

a printing unit including the drum; and a pressure roller positioned below the drum and constructed to be shiftable between a press position where the pressure roller presses the outer peripheral wall by driving force of a solenoid device and a standby position of pressure roller apart from the outer peripheral wall, so as to position the pressure roller at the press position during a printing mode period and located at the standby position during a period other than the printing mode period.

11. The stencil printing machine according to claim 1, further comprising:

a printing unit including the drum;

an ink supply device which supplies ink to a surface of the drum;

a stencil confirming sensor which detects a predefined condition of the stencil sheet with respect to the outer peripheral wall;

a reference position detecting sensor which detects a reference position of the drum, and a rotary encoder which detects rotation corresponding to drum position, thus enabling detection of a rotation position of the drum; and a pressure roller positioned below the drum and constructed to be shiftable between a press position where the pressure roller presses the outer peripheral wall by driving force of a solenoid device and a standby position of pressure roller apart from the outer peripheral wall, so as to position the pressure roller at the press position during a printing mode period and located at the standby position during a period other than the printing mode period.

* * * * *

UNITED STATES PATENT AND TRADEMARK OFFICE

CERTIFICATE OF CORRECTION

PATENT NO. : 7,415,926 B2
APPLICATION NO. : 11/032011
DATED : August 26, 2008
INVENTOR(S) : Nakamura et al.

It is certified that error appears in the above-identified patent and that said Letters Patent is hereby corrected as shown below:

Claim 2, Column 11, Line 27,
Please delete "comprises: p1 an ink"
and
replace with
-- comprises: an ink --

Signed and Sealed this

Twenty-eighth Day of October, 2008

JON W. DUDAS
*Director of the United States Patent and Trademark Office*